US009003707B2

(12) United States Patent
Reddmann

(10) Patent No.: US 9,003,707 B2
(45) Date of Patent: Apr. 14, 2015

(54) POSITIONING ELEMENT FOR MOTOR VEHICLE DOORS AND PANELS

(75) Inventor: Uwe Reddmann, Essen (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 0 days.

(21) Appl. No.: 14/008,626

(22) PCT Filed: Apr. 2, 2012

(86) PCT No.: PCT/DE2012/000342
§ 371 (c)(1),
(2), (4) Date: Feb. 10, 2014

(87) PCT Pub. No.: WO2012/130223
PCT Pub. Date: Oct. 4, 2012

(65) Prior Publication Data

US 2014/0144085 A1 May 29, 2014

(30) Foreign Application Priority Data

Mar. 31, 2011 (DE) ..... 10 2011 015 669

(51) Int. Cl.

| | |
|---|---|
| ***E05F 11/00*** | (2006.01) |
| ***E05B 65/00*** | (2006.01) |
| ***E05F 15/18*** | (2006.01) |
| ***E05B 81/20*** | (2014.01) |

(Continued)

(52) U.S. Cl.
CPC ..... *E05F 15/18* (2013.01); *E05B 81/20* (2013.01); *E05C 3/12* (2013.01); *E05F 7/005* (2013.01)

(58) Field of Classification Search
USPC ..... 49/275, 276, 277, 278, 379, 364; 312/319.2, 333, 405
See application file for complete search history.

(56) References Cited

U.S. PATENT DOCUMENTS 2,553,023 A * 5/1951 Walters ..... 49/276
3,605,459 A * 9/1971 Van Dalen ..... 70/144

(Continued)

FOREIGN PATENT DOCUMENTS

| | | |
|---|---|---|
| DE | 100 07 420 A1 | 8/2001 |
| DE | 198 35 994 B4 | 11/2008 |
| WO | 2007/090210 A2 | 8/2007 |

OTHER PUBLICATIONS

International Search Report for corresponding patent application No. PCT/DE2012/000342 dated Sep. 27, 2012.

*Primary Examiner* — Jerry Redman
(74) *Attorney, Agent, or Firm* — Renner, Otto, Boisselle & Sklar, LLP

(57) ABSTRACT

A positioning element permits the panel or engine bonnet of a motor vehicle to be brought from the closed position into a position in which a gap forms between the upper edge of the opening and the lower edge of the panel. The panel can thus easily be unlocked and fully opened. The positioning element with inner lever and outer lever is connected to a drive component, which via the drive element and the drive pawl with a detent ensures that the panel is brought in a simple manner via the levers into the first raised position, for which purpose the detent is pushed into the recess of the outer lever and thus brings the outer lever and the inner lever into the first raised position. Once the panel has been brought by spring loading into the second raised position with the aid of the spring-loaded inner lever, the upward travel is completed, so that by means of the spring force associated with the outer lever, said outer lever then quickly pivots both levers back into the initial position.

10 Claims, 4 Drawing Sheets

(51) Int. Cl.
*E05C 3/12* (2006.01)
*E05F 7/00* (2006.01)

(56) References Cited

U.S. PATENT DOCUMENTS 5,020,838 A * 6/1991 Fukumoto ..... 292/201
5,613,716 A * 3/1997 Cafferty ..... 292/216
5,642,636 A * 7/1997 Mitsui ..... 70/237
6,357,803 B1 * 3/2002 Lorek ..... 292/99
6,446,391 B1 * 9/2002 Timothy ..... 49/332
6,910,302 B2 * 6/2005 Crawford ..... 49/379
8,226,132 B2 * 7/2012 Zinn ..... 292/200
8,272,165 B2 * 9/2012 Tomioka ..... 49/275
8,584,402 B2 * 11/2013 Yamaguchi ..... 49/379
2011/0254292 A1 * 10/2011 Ishii ..... 292/341.15

* cited by examiner

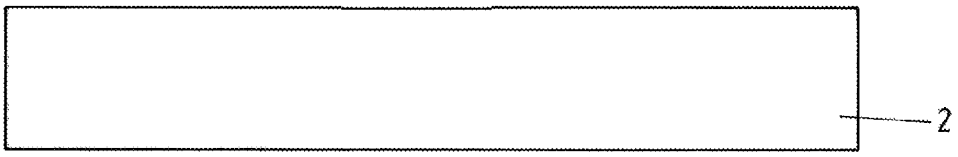
Fig.4
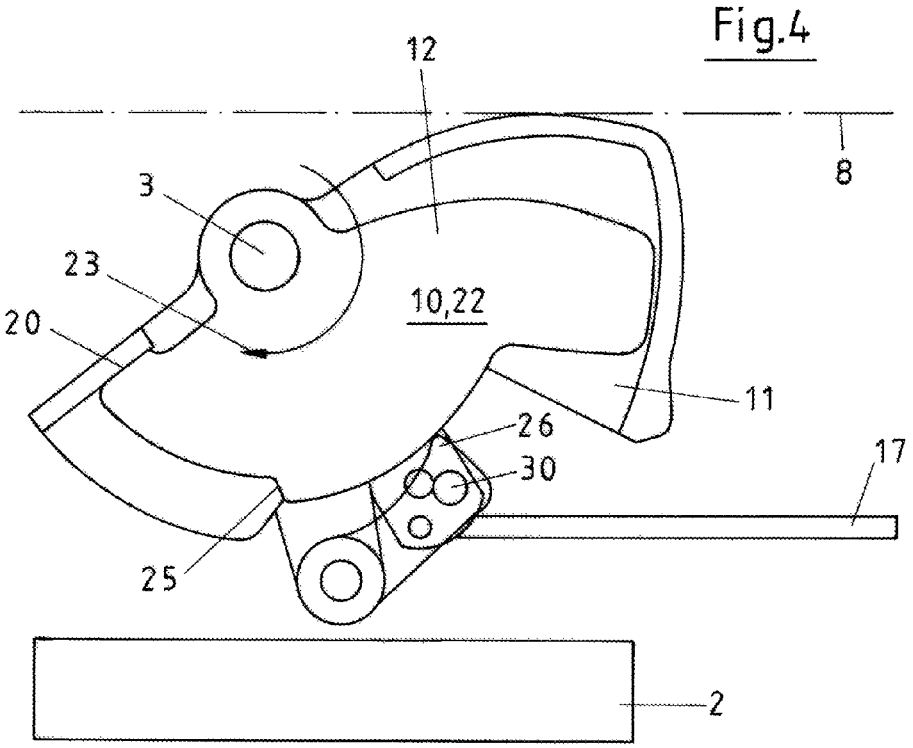
Fig.5
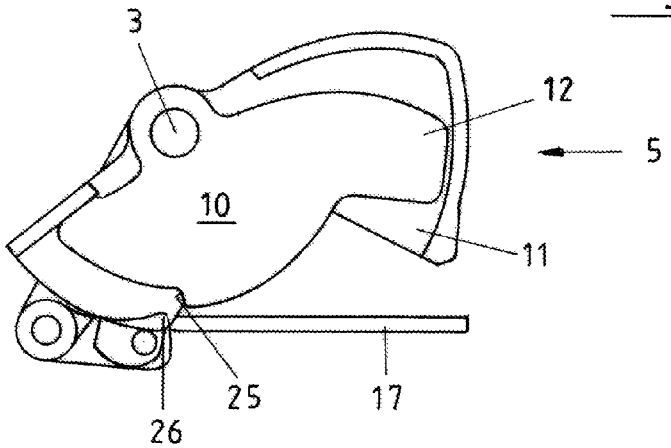

POSITIONING ELEMENT FOR MOTOR VEHICLE DOORS AND PANELS

FIELD OF THE INVENTION

The invention relates to a positioning element for motor vehicle doors and panels, in particular for trunk lids and tailgates of passenger vehicles with or without actuation handle and which is pivotable between a closed position and a raised position which contains a lifting element activated by the unlocking of the lock of the panel, said element being designed to pivot the panel with the aid of a motor into the raised position and then back into the closed position.

BACKGROUND OF THE INVENTION

Such positioning elements for motor vehicle doors and panels, in particular those for trunk lids and tailgates are generally known. DE 198 35 994 B4 shows and describes an operating device for a panel, in particular for the tailgate of a motor vehicle, in which the panel is pivoted by a so-called ejection device is such a way that a gap is formed and the panel can be gripped through this gap and can be opened. In addition, a handle is provided which only after unlocking of the lock can be automatically pivoted back from a retracted rest position into an operating position. A so-called ejection device comprises a rod with a rack-like shape cooperating with a gear driven by a spindle nut. According to DE 200 16 292 U1 a respective closure means, consisting of a rotary latch and a pawl and a respective pawl drive means is designed in such a way that the pawl drive means moves the rotary latch into a raised position, forming a gap. The used pawl drive means can steer the rotary latch into a raised position using a rigid connecting lever as part of a forced guidance. Similar arrangements are known from U.S. Pat. No. 5,020,838 A and DE 298 13 797 U1. DE 298 12 121 U1 also discloses a positioning element for tailgates, bonnets and similar in which a lifting means produces a gap between a seal and a counterseal surface, said lifting means being servo assisted by a common drive means of the handle extension. This arrangement requires a handle but also uses a spindle and spindle nut and further drive means units. The actual lifting means is arranged at the edge of the closure means and acts with its ram head on a support plate in order to open the gap. In the closure means for a tailgate disclosed in DE 197 00 887 B4 a motor drive means is also initiated for opening the tailgate by a gap width, using a key or a separate actuation handle, said drive means displacing a control cam, which in turn moves the closure element into the exit position to the counter locking part. In all of these positioning elements for the bonnet and or other motor vehicle panels an intentional or accidental slamming of the panel from the just overcome gap opening is difficult because of the coupling of the individual parts. This can result in individual drive means parts of the positioning element being damaged.

SUMMARY OF THE INVENTION

The invention therefore has the task of suggesting a positioning element that can also cope with an immediate slamming shut of the motor vehicle panel without damage.

The invention solves the tasks by providing a two-part lifting element, containing an outer and inner lever, pivotable and displaceable in relation to each other and that are detachably connected to a drive element rotatably mounted on a drive lever, in which the inner lever is designed to move anticlockwise and the outer lever is designed to actively pivot back in clockwise direction.

Such a designed positioning element can, first of all, be advantageously secured to and arranged on the inside wall of the interior covered by the panel in such a way that it is stylishly arranged and also does not hinder during loading or unloading of the vehicle interior. It is not directly arranged on or in the lock housing, but can instead be specifically located in an area where space is available. It is connected to the drive element and thus the outer lever by means of a rod or similar, so that the outer lever and the inner lever can be easily moved from the base position into a first raised position. The outer lever is designed to actively pivot back in clockwise direction and the inner lever in anticlockwise direction. Preferably they are acted upon by a spring accordingly. The inner lever can be detached from the outer lever and the drive means element, so that it can be pivoted further after having reached a first raised position, in order to actually move the panels into the open position. The outer lever and the inner lever are then pivoted together in clockwise direction and back into the base position, so that it can then no longer be influenced or damaged by the panel being slammed shut. The overall result is a positioning element carrying out the movements including pivoting back in quick succession and in such an automated way that no errors can occur.

An appropriate embodiment provides for the inner lever and the outer lever being spring-loaded. The inner lever is spring-loaded in anticlockwise direction and the outer lever in clockwise direction, so that with the aid of the spring-loaded inner lever the inner lever can be pivoted further on its own after separation of the levers from each other and from the drive element in order to reach the final open position for the panel or to instigate that the panel is pushed up in this position. The force of its spring then pivots the outer lever in clockwise direction together with the inner lever and back into the base position, so that it can no longer be damaged by any slamming shut of the panel. The spring action ensures a simple and reliable pivoting of both levers in the long-term.

The invention further provides for the inner lever to be designed in such a way that during a relative movement or rather the relative movement in relation to the outer lever, it releases the drive means element, provided as a drive pawl from the outer lever and thus from the drive element with the aid of a stop cam. Upon reaching this interim position the inner lever causes the separation from the outer lever and the drive element so that the inner lever alone is, depending on the arrangement of the spring, pulled or pushed in the position described above by means of the spring allocated to it.

In order to ensure the joint a well as the separate movement of the two levers, the invention provides for the inner lever to be partially encompassing the outer lever and to contain a stop ring. The outer lever is thus practically located in the inner lever and in such a way that, on one hand, it carries along the inner lever by means of the stop ring when pivoting open and ensures, on the other hand, through the stop ring that the inner lever can be pivoted back again even against the spring force assigned to it.

In order to ensure that the described sequence of movements takes place, i.e. of the inner lever and then the other way around the pulling back of the outer lever and inner lever to their base position, the invention provides a greater spring loading for the outer lever than for the inner lever, i.e. a 20-60% greater spring loading. Depending on the dimensions of the overall positioning element or other circumstances, the spring loading can be selected for both levers. In this way it is in any case ensured that after the inner lever has been pivoted into the second raised position by the respective spring force, that after releasing of the connection between the outer lever and the inner lever the outer lever also carries along the inner lever as a result of the spring force exerted on it and pivots it back to the initial base position. The positioning element is thus also available again for the next opening process.

A reliable acting on the outer lever by the drive element and thus at the same time also on the inner lever is ensured by the fact that the outer lever contains a recess accommodating the drive element and that the drive element contains a corresponding detent. At the start of the opening process, the drive means acts on the outer lever via the drive element as a result of the drive element with the corresponding detent being inserted in the recess of the outer lever. For this purpose, the recess and the detent are aligned with each other and shaped in such a way that during the subsequent movement, the contact between the drive element and outer lever and thus also the inner lever is retained. The two components are also formed in such a way that at a certain point in time they are separated from each other by the inner lever in such a way that the inner lever can be pivoted further by the force of the spring.

The "disengaging", i.e. the separating from the outer lever and the drive element is ensured by the fact that the inner lever contains an outer curved edge shaped to influence the stop cam during the said relative movement. This outer curved edge moves the inner lever in such a way that it moves against the stop cam, lifting the drive element or the drive pawl off the stop cam, breaking the contact between the drive element and outer lever and thus at the same time also releasing the inner lever allowing it to be pivoted further by the spring force.

In order to ensure that the drive means cannot influence or even prevent the inner and outer lever from being pivoted back, the invention provides for the inner lever to be designed in such a way that, upon reaching the second raised position, it initiates a return of the drive means to the base position and, at the same time, releases the return spring of the outer lever. So as soon as the inner lever reaches the second raised position and no contact exists between the drive means and the outer lever, the drive means is switched off or is switched in such a way, that it does not impede a return to the base position, allowing this return movement to be quickly and evenly carried out by the force of the installed spring, without allowing any endangering of the positioning element.

As part of the invention it is furthermore advantageous for the outer lever to be made of metal and the inner lever and the stop ring to be made of plastic. What is advantageous is that the inner lever, encompassing the outer lever, is made of plastic, which means that it can also be conveniently brought into contact with the panel without causing any scratches or similar. The outer lever, transferring the main force, is on the other hand made of metal.

The invention is, in particular, characterised by the fact that it provides a positioning element that with or without operating handle allows a reliable operation of, for instance, the trunk lid or the tailgate of a passenger car. Upon operation of the lock of the panel, the lifting element becomes active, which then ensures that the drive element pivots the outer and inner lever into the first raised position. This happens quickly and already then is the desired gap formed, making it possible to unlock the panel or bonnet and pivot it open. In the mean time the force of the spring moves the inner lever, which is separated from the outer lever at the time, into a position referred to as second raised position and which allows the automatic or manual full opening of the panel. As the two levers are separated from each other and from the drive means element, the outer lever can now be pivoted back into its base position by its spring, carrying along the inner lever, after which the closed position can be reached again with the aid of the drive means. The entire process can be relatively quick, ensuring that even if the panel or the door are accidentally or intentionally quickly slammed shut again, this does not damage or negatively influence the positioning element in any other way.

BRIEF DESCRIPTION OF THE DRAWINGS

Further details and advantages of the object of the invention are disclosed in the below description of the respective drawing, depicting a preferred embodiment and the respective details and components, in which:

FIG. 4 shows the positioning element of FIG. 1 after reaching the base position and FIG. 5 shows the positioning element of FIG. 1 after the return of the drive means element.

DETAILED DESCRIPTION OF THE INVENTION

Figure 1:
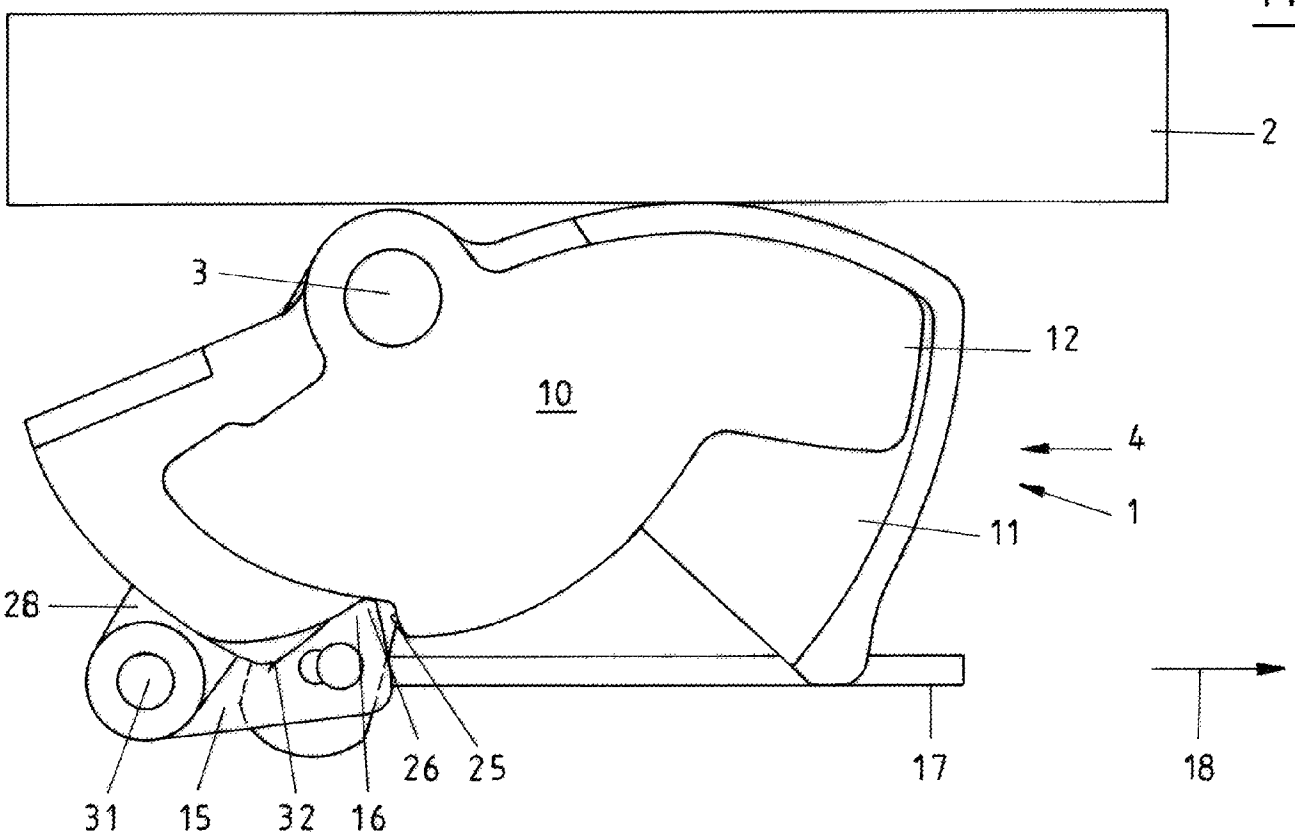
FIG. 1 shows a simplified representation of a positioning element in the closed position

FIG. 1 shows a positioning element 1, as for instance installed in a motor vehicle, in order to move the panel 2—only indicated—into a gap position and then to finally unlock and pivot open panel 2. Numeral 3 indicates the pivot axis around which the positioning element 1 is pivoted by means of its lifting element 10. FIG. 1 shows the so-called closed position 4, i.e. the panel 2 rests on the upper edge 8 of the opening The lifting element 10 consists of two parts and comprises an inner lever 11 and an outer lever 12, with the inner lever 11 partly encompassing the outer lever 12.

In FIG. 1 the outer lever 12 is detachable connected to the drive element 16 and thus with the drive means 17. The drive element 16, in this case a drive pawl 15, is moved from the position shown in FIG. 1 into the position shown in FIG. 2 by the rod-shaped drive means 17. As a result, the detent 26 is pushed into the recess 25 in the outer lever 12, so that the pivoting of the drive pawl 15 also causes the outer lever 12 and the inner lever 11 to be moved and pivoted at the same time.

Figure 2:
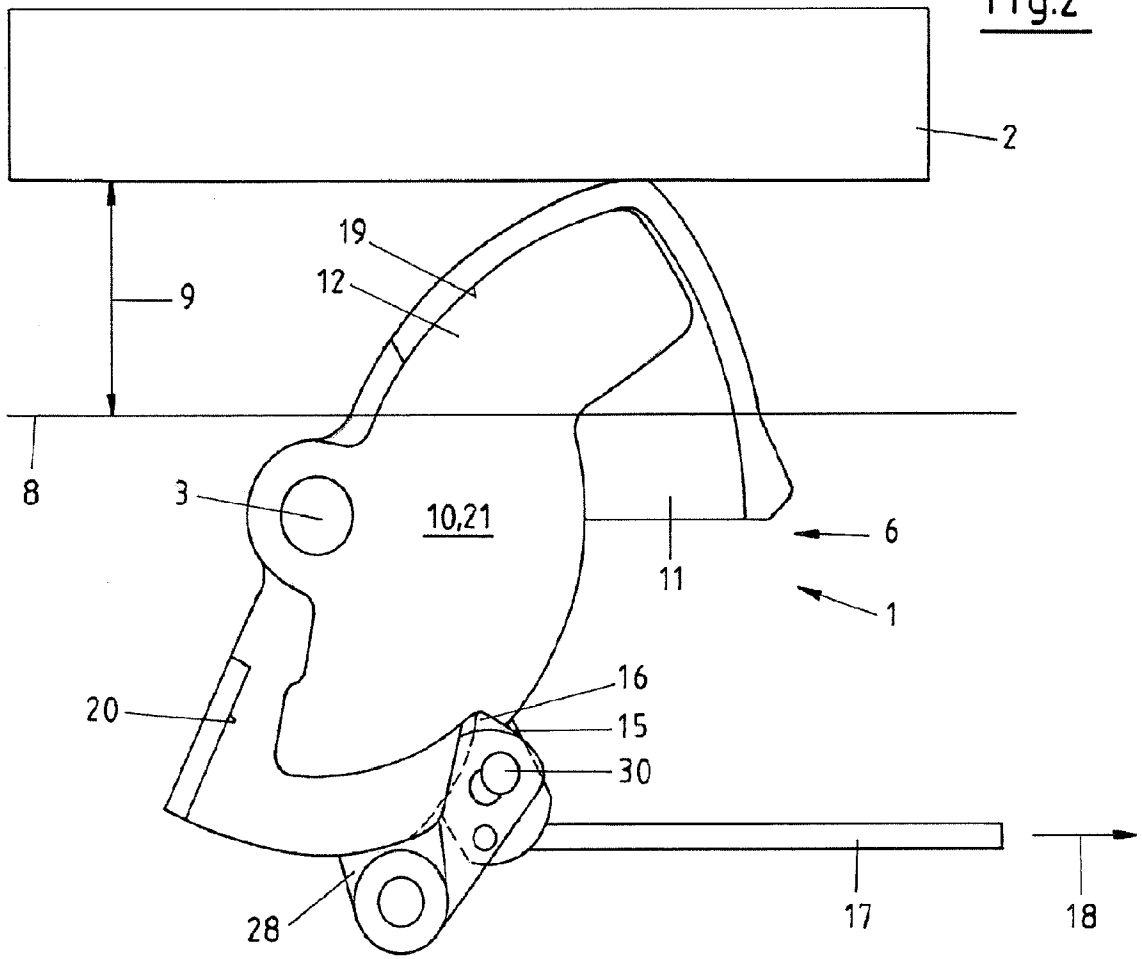
FIG. 2 shows the positioning element of FIG. 1 in the first raised position

The drive means 17, in this case a type of rod, is moved in the pulling direction 18, so that the drive element 16 or the drive pawl 15 moves from the position shown in FIG. 1 into the position shown in FIG. 2, i.e. pivots around pivot axis 3. During this movement into the first raised position 6, the outer lever 12 pushes up the panel 2, creating the gap 9. At the same time the outer lever 12 carries along the inner lever 11 with the stop ring 19 ensuring that the inner lever 11 is carried along. As apparent, the stop ring 19 is considerably larger than the stop ring 20, responsible for the return stroke. FIG. 2 thus shows the so-called upwards lift 21, completed once the first raised position 6 has been reached.

Figure 3:
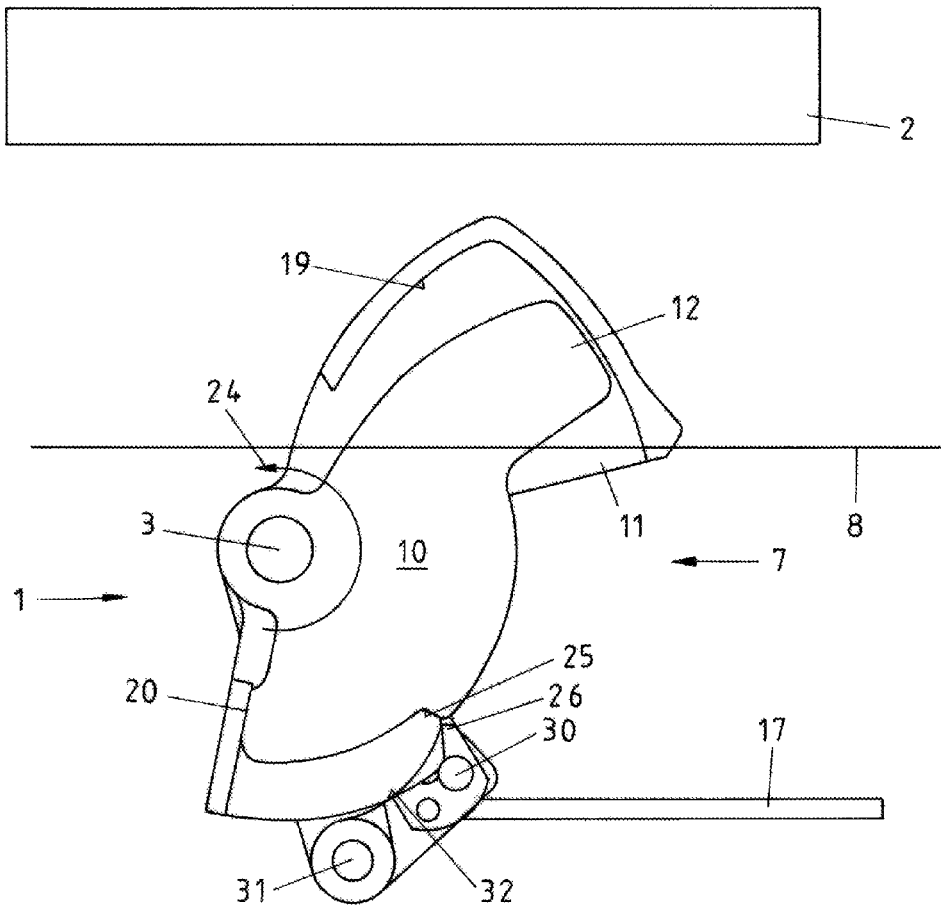
FIG. 3 shows the positioning element of FIG. 1 in the second raised position and in the respective unlocked state

FIG. 3 shows the second lifting movement, serving to separate the two levers 11, 12 and the drive element 16 from each other, during which as a result of the relative movement of the inner lever 11 in relation to the outer lever 12, the inner lever 11 with its outer curved edge 32 comes into contact with the stop cam 30, ensuring that the drive pawl 15 or the drive element 16 and the levers 11, 12 are separated from each other. For this purpose the detent 26 of the drive element 16 is pushed out of the recess 25 of the drive element 16. This movement is made possible as the drive element 16 or the drive pawl 15 can be pivoted slightly around the pivot joint 31.

In the position shown in FIG. 2 or after release of the detent 26 from the recess 25, the spring—not visible in this Figure—can now pivot the inner lever 11 into the position shown in FIG. 3, i.e. the panel 2 is pivoted up into the position shown in FIG. 3 to allow full opening, where required. The force of the spring acts on the outer lever 12 in anticlockwise direction 24. After opening of the panel 2 and reaching the second raised position 7 the now stronger spring of the outer lever 12 becomes effective and ensures that the outer lever 12 is pivoted under the upper edge 8 of the opening of the motor vehicle whilst carrying along the inner lever 11. It is consequently in a position in which a slamming shut of the panel 2 cannot cause any damage to the positioning element 1.

The downward stroke 22 is not fully completed in FIG. 4. The drive element 16 or drive pawl 15 still has to be pushed back or displaced from the position shown in FIG. 5 with the aid of the drive means 17. This is possible as the drive 17 and outer lever 12 are not in contact with each other. The drive pawl 15 must first be pushed back by the drive means 17 in order to engage again in the recess 25 with its detent 26. Only then can the drive pawl 15 be moved back around the pivot joint 31 into the said position (opening position), with the pivot joint 31 being arranged on the drive lever 28.

The position shown in FIG. 5 in general corresponds with that of FIG. 4, only the drive pawl 15 or the drive element 16 are pushed back into the so-called base position 5 as mentioned above. Upon closing of the panel 2, the positioning element 1 reaches the position shown in FIG. 1 so that the closed position 4 has been reached again.

All specified characteristics, also those only shown in the drawings are separately or together regarded as characteristics important for the invention.

The invention claimed is:

1. Positioning element for a motor vehicle panel which is pivotable between a closed position and a raised position, the positioning element comprising:

a lifting element activated by unlocking of a lock of the panel, with the panel being designed to be pivoted into the raised position and then back into the closed position, and a drive element pivotably mounted on a drive lever, wherein the lifting element comprises an outer lever and an inner lever, pivotable or slideable in relation to each other and which are releasably connected to the drive element, and the inner lever is designed to actively pivot back in an anticlockwise direction and the outer lever in a clockwise direction when the lifting element is driven by the drive element.

2. Positioning element according to claim 1, wherein the inner lever and outer lever are acted upon by a spring.

3. Positioning element according to claim 1, wherein the inner lever is designed in such a way that during a relative movement in relation to the outer lever the drive element, designed as a drive pawl, is released from the outer lever by a stop cam.

4. Positioning element according to claim 3 wherein the inner lever contains an outer curved edge designed to act on the stop cam during the relative movement.

5. Positioning element according to claim 1, wherein the inner lever is designed to partly encompass the outer lever and contains a stop ring.

6. Positioning element according to claim 5, wherein the outer lever is made of metal and the inner lever and the stop ring are made of plastic.

7. Positioning element according to claim 1, wherein the outer lever is subjected to a greater spring loading than the inner lever.

8. Positioning element according to claim 7, wherein the outer lever is subjected to a 20-60% greater spring loading than the inner lever.

9. Positioning element according to claim 1, wherein the outer lever contains a recess accommodating the drive element and that the drive element has a corresponding detent.

10. Positioning element according to claim 1, wherein upon reaching a second raised position, the inner lever is designed to cause the drive element to move back into a base position, releasing a return spring of the outer lever at the same time.

* * * * *